United States Patent [19]

Sokoly et al.

[11] 4,131,306

[45] Dec. 26, 1978

[54] DOOR LOCK ACTUATOR WITH OVERRIDE MECHANISM

[75] Inventors: John Sokoly, Detroit; Kenneth N. Roberts, Canton, both of Mich.

[73] Assignee: Essex Group, Inc., Fort Wayne, Ind.

[21] Appl. No.: 815,480

[22] Filed: Jul. 14, 1977

[51] Int. Cl.[2] ..... E05C 13/10

[52] U.S. Cl. ..... 292/201

[58] Field of Search ..... 292/1, 144, 201, 336.3

[56] References Cited

U.S. PATENT DOCUMENTS

| | | | |
|---|---|---|---|
| 3,039,290 | 6/1962 | Johnstone | 292/201 X |
| 3,062,034 | 11/1962 | Leslie | 292/201 X |
| 3,243,216 | 3/1966 | Peters | 292/201 |

*Primary Examiner*—Richard E. Moore

*Attorney, Agent, or Firm*—Lawrence E. Freiburger; Robert D. Sommer

[57] ABSTRACT

A door lock actuator includes a reversible linear power drive means for actuating the lock and manual means for actuating the lock. Whenever the manual means is used to actuate the lock, the power drive means is reversed through the lock mechanism. If the drive means should become jammed for any reason, the present invention provides a simple yet reliable override bracket which still allows the lock to be manually actuated by allowing the drive means to be disjoined from its mounting.

2 Claims, 2 Drawing Figures

DOOR LOCK ACTUATOR WITH OVERRIDE MECHANISM

BACKGROUND OF THE INVENTION

Door lock actuators for automobiles are becoming a popular accessory for automobiles. Because of the increased demand for this type of accessory, automobile manufacturers have endeavored to make this accessory available on a wide range of models. Different car models have different door configurations and along with the increased demand for the power door lock accessory has arisen the need for a universal door lock actuator which can be universally installed in a number of door and lock configurations.

An aditional constraint is placed on the design of automobile door lock actuators in that they must be as safe and trouble-free as possible. A further constraint is placed on the design of such an actuator in that provision must be made for manual operation in the event of a power failure or an emergency.

To meet the need for a more universal actuator, the device disclosed in copending application Serial No. 669,942, assigned to the same assignee as the present application was developed. The actuator of this application employs a screw drive principle to produce the desired linear movement and has an internal override device which allows the screw drive actuator to be manually overridden. Where the internal screw drive actuator with override cannot be employed, a conventional screw drive actuator with an external override clip such as the one disclosed in copending application Serial No. 735,309, also assigned to the same assignee as the present invention, may be utilized. However, this override clip suffers from the drawback that its use is limited to systems in which a proper angular relationship exists between two of the driving components. Accordingly, both the screw drive actuator with internal override and the override clip are limited in their application and do not provide the desired universality.

SUMMARY OF THE INVENTION

It is thus an object of the present invention to provide a simple, reliable, universal driving mechanism for an automobile power door lock system which also has the desirable manual override feature.

This object as well as others which will become apparent as the description of the invention proceeds is accomplished by mounting the linear, reversible actuator for a power door lock system on a bracket which provides a yieldable mounting for the actuator such that the actuator is disengaged from the bracket in the event the actuator is jammed and is manually overridden. The bracket provides a gimbal mounting for the actuator, and thus accommodates various mounting angles for the actuator as it is used in different car models.

BRIEF DESCRIPTION OF THE DRAWINGS

During the course of the detailed description of the invention, reference will be made to the drawings, in which.

DETAILED DESCRIPTION OF THE INVENTION

Figure 1:
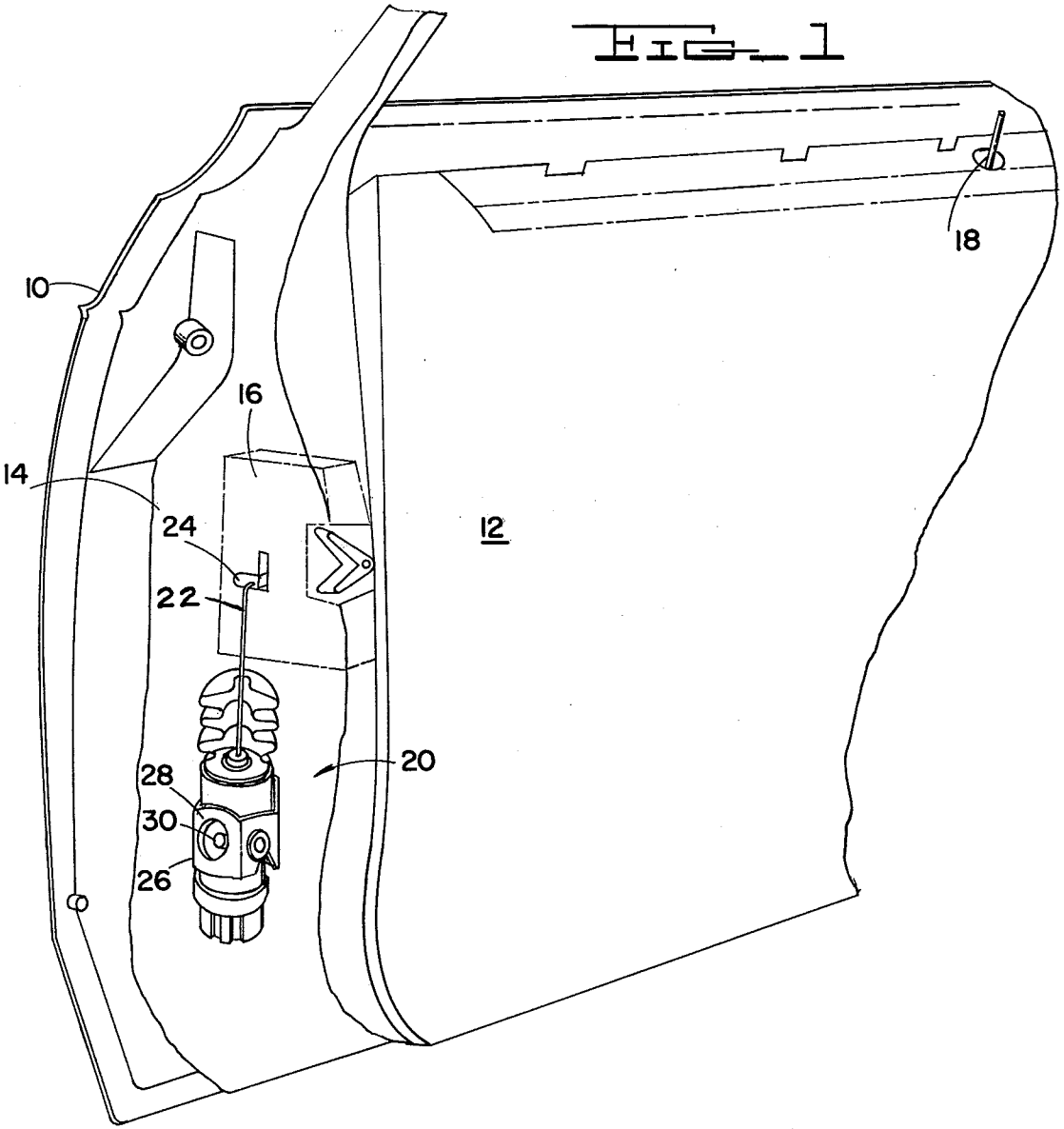
FIG. 1 is a cut-away, perspective assembly drawing showing a power door lock actuator installed in accordance with the present invention.

Referring firstly to FIG. 1, there is disclosed an automobile door having an outside sheet metal surface 10, an inside surface 12, and a latch surface 14 located approximately perpendicularly to the outside and inside surfaces. In FIG. 1 the latch surface 14 is not shown in order to more clearly show the door lock actuating components. More specifically, a latch assembly 16 is secured to the inside of latch surface 14 such that it engages a corresponding latch bar (not shown) on the vehicle body to maintain the door in a closed position. The latch assembly 16 is conventional and, accordingly, will not be described in detail.

The latch assembly 16 includes a locking mechanism (not shown) which can be actuated by two actuation methods. In the first actuation method, manual means in the form of a conventional door lock button 18 is linked to the latch assembly 16 in such a manner that it allows the latch to be operated in an unlocked position and prevents the latch from being operated in a locked position. The linkage between the door lock button 18 and latch 16 is conventional and has been omitted from the drawings for sake of clarity. The second means for locking the latch assembly 16 comprises an electrically operated, reversible linear actuator 20. The actuator 20 includes a linearly movable output shaft 22 which is connected to a locking lever 24 situated on latch assembly 16. When locking lever 24 is in a first position, latch assembly 16 is allowed to operate. However, when locking lever 24 is placed in a second or locked position, the latch assembly 16 is prevented from being operated. Actuator 20 can be any type of power operated actuator which is capable of being machanically moved as well. An actuator with an internal screw drive is the preferred type of actuator, although other types of actuators may be employed.

Figure 2:
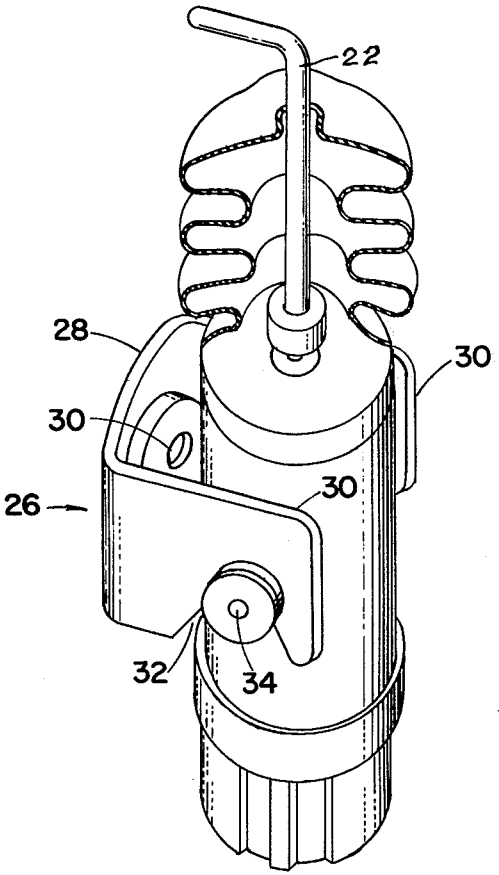
FIG. 2 is an elevational perspective view of the actuator and bracket override mechanism of the invention.

In accordance with the present invention, the actuator 20 is mounted on the inside surface of the latch surface 14 by a yieldable bracket 26 shown in more detail in FIG. 2. The bracket includes a base portion 28 having a central aperture 30 therein which is used to bolt, rivet or otherwise mount the bracket 26 to the latch surface 14 of the car door. In addition, the bracket 26 has a pair of mounting tabs 30 extending from the base 28 at substantially right angles. Each mounting tab 30 has an identical wedge shaped mounting slot 32 therein, which is situated in the tab so that a mounting ear 34 on the actuator housing can be inserted therein. It will thus be seen that bracket 26 forms a gimbal type mounting for the actuator. The wedge shape slots 32 lead into a straight slot (not shown) in which the actuator is normally retained as a result of the tight fit between the mounting ears 34, the straight slot and mounting tab 30.

In briefly describing the operation of the power door lock system and the overload bracket of the invention, it will be assumed that the system is in the position shown in FIG. 1 (in the unlocked position). If the actuator is operating normally, the lock may be operated manually by moving the door lock button 18 or electrically by moving a switch inside the automobile (not shown). If the lock is manually operated by moving the door lock button 18, the movement will be translated through the latch assembly 16 to cause the actuator 20 to be manually reversed. If the actuator 20 is actuated to lock or unlock the door, movement of shaft 22 will be likewise translated through the latch mechanism 16 to move the door lock button 18. While the system is operating normally, actuator 20 will be retained in its gimbal mounting. However, if actuator 20 should become jammed for any reason while the system is in the locked position, the door may still be manually unlocked (with some additional effort) by pulling on the door lock button 18. Pulling on door lock button 18 will cause lock lever 24 to move downwardly, and if the actuator 20 is jammed, it will "pop" out of its mounting to allow the door lock to be opened.

An exemplary embodiment of the invention has been disclosed, and it is recognized that obvious modifications will occur to those skilled in the art. Accordingly, the scope of the invention is defined in the claims.

What is claimed is:

1. In a door locking apparatus including a locking mechanism movable between locked and unlocked positions, manually reversible power operated drive means connected to said locking mechanism for moving it between said locked and unlocked positions, non-yielding manual means connected to said lock mechanism for moving it between said locked and unlocked positions, said power operated drive means being caused to reverse whenever said manual means is used to lock or unlock said lock mechanism, the improvement which comprises:

bracket means for normally mounting said drive means in a fixed position relative to said locking mechanism, said bracket means including means for allowing disengagement of said drive means and said bracket means whenever said drive means is jammed and said manual means is moved from said locked position to said unlocked position.

2. The improvement as claimed in claim 1, wherein said bracket means comprises a base mounting portion and a pair of integral mounting tabs extending therefrom, each said integral mounting tab havng a pair of spring arms defining a slot therebetween, and mounting means on said drive means insertable into, and normally retained in said slots.

* * * * *